United States Patent [19]

Jefferson

[11] 4,422,425

[45] Dec. 27, 1983

[54] FUEL INJECTION PUMP

[75] Inventor: John R. Jefferson, Rainham, England

[73] Assignee: Lucas Industries Limited, Birmingham, England

[21] Appl. No.: 473,265

[22] Filed: Mar. 14, 1983

Related U.S. Application Data

[63] Continuation of Ser. No. 193,084, Oct. 2, 1980, abandoned.

[30] Foreign Application Priority Data

Oct. 20, 1979 [GB] United Kingdom ..... 7936480

[51] Int. Cl.[3] ..... F02B 23/10

[52] U.S. Cl. ..... 123/450; 123/179 L; 417/462; 417/253

[58] Field of Search ..... 123/450, 504, 179 L, 123/501, 451, 449, 502, 500; 417/462, 221, 251–253

[56] References Cited

U.S. PATENT DOCUMENTS

| | | | |
|---|---|---|---|
| 3,091,230 | 5/1963 | Evans | 417/462 |
| 4,055,387 | 10/1977 | Potter | 123/450 |
| 4,067,304 | 1/1978 | Potter | 123/179 L |
| 4,325,676 | 4/1982 | Fenne | 417/462 |
| 4,358,256 | 11/1982 | Jefferson | 417/462 |

*Primary Examiner*—Charles J. Myhre
*Assistant Examiner*—Carl Stuart Miller

[57] ABSTRACT

A fuel injection pump of the rotary distributor type has angularly adjustable stop rings which limit the outward movement of the pumping plungers so as to control the maximum fuel output of the pump. The stop rings have an outwardly extending curved stop surface so that the maximum fuel output can be altered by altering the angular setting of the rings. The latter portion of the stop surface is arranged to curve outwardly at a greater rate so that as the engine speed increases the plungers no longer follow paths determined by said surface so that the maximum fuel delivery of the pump decreases.

2 Claims, 3 Drawing Figures

FUEL INJECTION PUMP

This application is a continuation of application Ser. No. 093,084, filed Oct. 2, 1980 now abandoned.

This invention relates to a liquid fuel injection pump for supplying fuel to a multi-cylinder internal combustion engine and of the kind comprising a rotary distributor member housed in a body and driven in use in timed relationship with an associated engine, a transverse bore formed in the distributor member and a plunger in said bore, a delivery passage communicating with the bore and arranged to register in turn with outlets in the body, as the distributor member rotates and during successive inward movements of the plunger, a cam ring surrounding the distributor member and having inwardly extending camlobes for imparting said inward movements to the plunger, fuel supply means for supplying fuel to the bore during at least part of the time when the plunger is allowed to move outwardly by the cam lobes, said fuel supply means including an inlet port in the body to which fuel is supplied from a low pressure source and a passage in the distributor member for registration with said port, flow control means for controlling the amount of fuel supplied through said port and stop means for limiting the outward movement of the plunger.

Such pumps are well known in the art and two forms of stop means are known. The first form of stop means comprises a ring which is mounted on the distributor member and rotates therewith. The ring has a surface for engagement by a part associated with the plunger, the surface being shaped so that as the relative angular setting of the ring and distributor member is changed, the amount by which the plunger can move outwardly will vary. The second form of stop means comprises a ring mounted in the body of the pump. The ring does not rotate with the distributor member but it can be moved angularly about the axis of rotation of the distributor member. The internal surface of the ring defines an arcuate stop surface the distance of which from the axis of rotation of the distributor member varies along the length of the stop surface. The present invention is concerned with a pump having the second form of stop means.

It is well known in the fuel pump art that the maximum quantity of fuel which can be supplied to an engine should after say 60% of the maximum allowed engine speed, start to decrease. This reduction of the maximum fuel provides what is known in the art as "torque control". It means that if for example the engine is operating at seven eights of its maximum speed an increase in the load on the engine while it will cause a reduction in the engine speed will also result in more fuel being supplied to the engine and hence the engine will develop more torque.

The provision of torque control is usually effected by utilizing a speed responsive device such for example as a piston responsive to the output pressure of allow pressure fuel supply pump or by a centrifugal mechanism. Both these arrangements lead to complications in the construction of the pump and the object of the present invention is to provide a pump of the kind specified having the second form of stop means and having torque control.

According to the invention in a pump of the kind specified said stop means comprises a ring mounted within the body of the pump and defining a stop surface for engagement by a part associated with said plunger to limit the outward movement of the plunger, as the distributor member rotates, said stop surface being curved with the distance of said surface from the axis of rotation of the plunger increasing along the length of the surface, the contour of the latter portion of the stop surface being such that as the speed of rotation of the distributor member increases the plunger no longer follows a path defined by said surface so that the extent of outward movement of the plunger is reduced as compared with the situation at lower speeds where the path of the plunger is determined by the stop surface.

One example of a pump in accordance with the invention will now be described with reference to the accompanying drawings in which.

Figure 1:
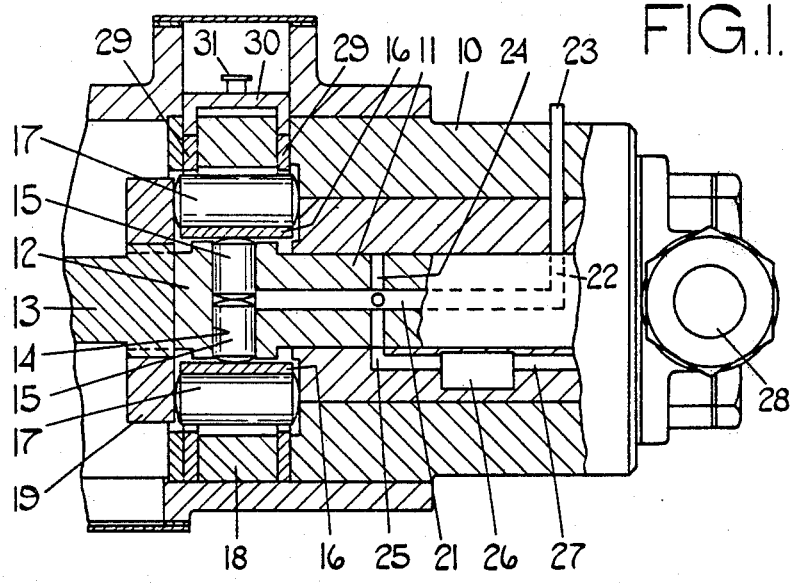
FIG. 1 is a diagrammatic sectional side elevation of pump in accordance with the invention.

Referring to FIG. 1 of the drawings the pump comprises a multi-part body 10 in which is mounted a rotary cylindrical distributor member 11. The distributor member has an enlarged portion 12 which is driven from a drive shaft 13. Formed in the distributor member 11 is a diametrically disposed bore 14 in which is mounted a pair of plungers 15. At their outer ends the plungers engage shoes 16 which carry rollers 17 for engagement with the internal peripheral surface of an annular cam ring 18 which surrounds the enlarged portion 12 of the distributor member.

Figure 2:
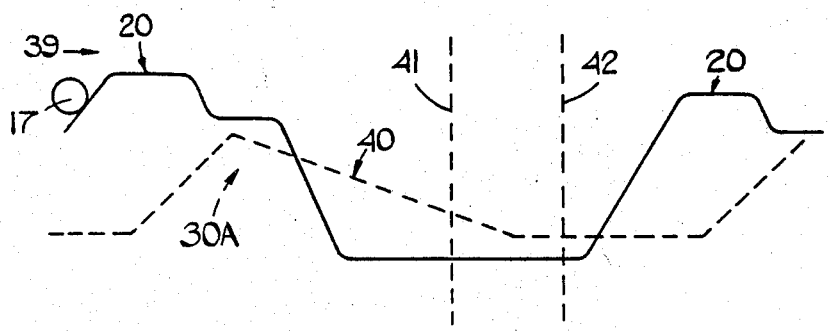
FIG. 2 is a developed view of a cam lobe profile and the profile of a stop ring forming part of the pump shown in FIG. 1.

The cam ring 18 has a plurality of inwardly extending cam lobes the profile of which is seen at 20 in FIG. 2. The shoes 16 are carried in slots formed in a sleeve 19 which is secured to or forms part of the drive shaft 13. Formed within the distributor member and communicating with the bore 14 is a longitudinal passage 21 which communicates with a radially disposed delivery passage 22. The passage 22 is disposed to register in turn with outlet ports 23 formed in the body and connected in use to the injection nozzles of the associated engine. Moreover, the longitudinal passage 21 also communicates with a plurality of inlet passages 24 formed in the distributor member and arranged to communicate in turn with an inlet port 25 which is formed in the body. The inlet port 25 communicates by way of a fuel control device 26 which may be a throttle, with a fuel supply passage 27 which communicates with the outlet of a low pressure supply pump the rotary part of which is conveniently mounted on the distributor member. The pump draws fuel through an inlet 28.

The apparatus so far described is conventional and during the time that the rollers and plungers are moved inwardly by the action of the cam lobes, fuel is displaced through an outlet 23. As the distributor member rotates further the delivery passage 22 is moved out of register with an outlet 23 and one of the inlet passages 24 moves into register with the inlet port 25. Fuel can now flow to the bore 14, the amount of fuel being controlled by the device 26. Thereafter the cycle is repeated and fuel is supplied to the outlets in turn during successive inward movements of the plunger.

In order to control the maximum amount of fuel which can be supplied by the pump to the associated engine, there is mounted in the body a pair of stop rings 29, these rings being disposed on opposite sides of the cam ring. The rings 29 in the example, are angularly movable within the body and have an internal profile as shown at 30A in FIG. 3. The stop rings 29 are interconnected by means of a bridging member 30 which is provided with an upstanding peg 31. The peg is connected to a mechanism for moving the rings angularly when for example, it is required to supply an additional quantity of fuel to the engine for starting purposes.

Turning now to FIG. 2 a roller 17 is shown engaging one of the cam lobes. The direction of movement of the roller as it is driven round the cam ring is shown by the arrow 39 and it will be seen to be in engagement with the leading flank of the cam lobe 20. The roller will also move upwardly as shown in FIG. 2 and this corresponds to inward movement of the associated plunger 15. Fuel is therefore being supplied through an outlet 23. When the roller reaches the crest of the cam lobe there is a delay during which no movement of the plunger takes place. This is followed by limited outward movement of the plunger to reduce the pressure in the various passages within the pump and also to reduce the pressure in the pipe-line connecting the outlet with the nozzle. Again there is a short delay during which time the delivery passage 22 moves out of register with the outlet 23 and an inlet passage 24 moves into register with the inlet port 25. The cam lobe falls to the base circle of the cam and the plunger can therefore move outwardly as fuel is supplied from the low pressure source.

The internal profile of the stop rings is shown at 30A and the important portion thereof is a stop surface 40 with which the rollers 17 can engage during the period when fuel can be supplied to the bore. The dotted line 41 indicates the closure of the inlet port 25 to an inlet passage while the further dotted line 42 indicates the opening of the delivery port to an outlet 23. Assuming for the moment that the device 26 is set so that there is substantially no restriction to the flow of fuel, then the rollers will engage the stop surface 40 of the internal peripheral surface of the stop rings and will act to restrain the outward movement of the plungers. Once the inlet port has been closed then no further fuel can be supplied to the bore and the position of the rollers and plungers will be such that the maximum amount of fuel is supplied by the pump to the associated engine. When the inlet port is closed the plungers cannot move outwardly but the rollers may leave the stop surface 40 of the stop ring and may float until they again engage the leading flanks of the lobes 20. It will be noted that before they do this the delivery passage 22 will be brought into communication with an outlet 23. Furthermore, it should be noted that if the device 26 is set to allow a restricted supply of fuel the stop surface 40 may not be brought into operation.

Figure 3:
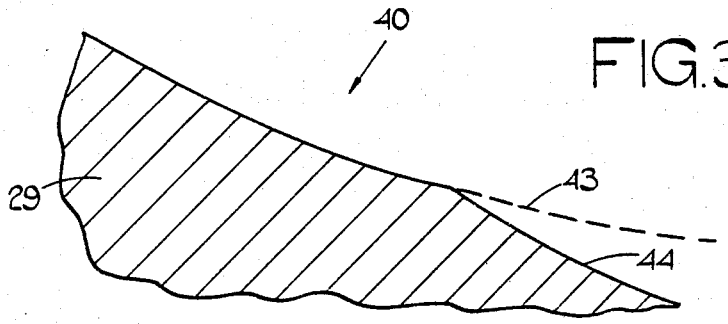
FIG. 3 shows a diagram of the profile of the stop ring as modified in accordance with the invention.

As shown in FIG. 3 the stop surface 40 is curved with the distance of said surface from the axis of rotation of the distributor member increasing along the length of the surface. Moreover, the latter portion 44 of the surface extends outwardly at a greater rate. At low speeds the rollers 17 and the associated shoes and plungers are able to follow the portion 44 of the surface. As the speed of rotation of the distributor member increases however there is an increasing tendancy for at least the plungers not to follow the path determined by the portion 44 of the surface. When the device or throttle 26 is set to maximum fuel the fuel rate into the bore 14 containing the plungers is sufficient to allow the plungers to be controlled by the surfaces 40. As the speed increases the flow rate may not be sufficient to allow the plungers to be controlled and hence they are not able to follow the path determined by the portion 44 of the stop surface. The stop surfaces 40 determine the maximum amount of fuel which can be supplied by the apparatus. If the throttle 26 is set to minimum fuel then the stop surfaces will probably not control the plunger movement except for example at very low speeds. Thus, the rollers may or may not follow the surface and this is difficult to determine but in any case this does not matter. The fact is that the outward movement of the plungers taking place before closure of the port 25, decreases as the speed increases. As a result the quantity of fuel supplied by the pump decreases and this is the effect which is required to provide torque control. The effect described is at least in part due to the fact that the degree of registration of an inlet passage 24 with the inlet port 25 is decreasing as the rollers 17 move along the portion 44 of the surface and this means that there is an increasing restriction to the flow of fuel.

I claim:

1. A liquid fuel injection pump for supplying fuel to a multi-cylinder internal combustion engine and of the kind comprising a rotary distributor member housed in a body and driven in use in timed relationship with an associated engine, a transverse bore formed in the distributor member and a plunger in said bore, a delivery passage communicating with the bore and arranged to register in turn with outlets in the body, as the distributor member rotates and during successive inward movements of the plunger, a cam ring surrounding the distributor member and having inwardly extending cam lobes for imparting said inward movements to the plunger, fuel supply means for supplying fuel to the bore during at least part of the time when the plunger is allowed to move outwardly by the cam lobes, said fuel supply means including an inlet port in the body to which fuel is supplied from a low pressure source, and an inlet passage in the distributor member for registration with said inlet port, flow control means for controlling the amount of fuel supplied through said port, control means for varying the maximum amount of fuel supplied to the engine automatically in accordance with engine speed during engine operation, said control means including stop means for limiting the outward movement of the plunger, said stop means comprising a ring mounted within the body of the pump and defining a stop surface which is engaged by a part associated with said plunger to limit the outward movement of the plunger, as the distributor member rotates, said stop surface being curved outwardly with respect to the plunger axis of rotation so that the distance of said surface from the axis of rotation of the plunger increases along the arcuate length of the surface, said stop surface including a first curved portion and a second curved portion which has a radius of curvature greater than the radius of curvature of said first curved portion, the contour of the second curved portion of the stop surface being such that as the speed of rotation of the distributor member increases the plunger can move off of said stop surface to no longer follow a path completely defined by said surface so that the extent of outward movement of the plunger is reduced as compared with the situation at lower speeds where the plunger remains in contact with said second curved portion to have the path of the plunger controlled entirely by the stop surface, whereby the maximum amount of fuel supplied to the engine is adjusted automatically in accordance with plunger angular speed with respect to said stop ring.

2. A pump according to claim 1 wherein said second curved portion is located behind said first curved portion with respect to plunger angular direction of movement.

* * * * *